US007077948B1

(12) United States Patent
Barre et al.

(10) Patent No.: US 7,077,948 B1
(45) Date of Patent: Jul. 18, 2006

(54) CATALYTIC DEWAXING PROCESS

(75) Inventors: Guy Barre, Grand Couronne (FR); Jean-Paul Darnanville, Grand Couronne (FR); Laurent Georges Huve, Amsterdam (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/856,022

(22) PCT Filed: Nov. 16, 1999

(86) PCT No.: PCT/EP99/09167

§ 371 (c)(1),
(2), (4) Date: May 16, 2001

(87) PCT Pub. No.: WO00/29512

PCT Pub. Date: May 25, 2000

(30) Foreign Application Priority Data

Nov. 18, 1998 (EP) ..... 98402934

(51) Int. Cl.
*C10G 47/18* (2006.01)

(52) U.S. Cl. ..... 208/111.35; 208/111.01; 208/58; 208/59; 208/97

(58) Field of Classification Search ..... 208/111.01, 208/111.35, 120.01, 120.35, 58, 59, 97
See application file for complete search history.

(56) References Cited

U.S. PATENT DOCUMENTS

| | | | | |
|---|---|---|---|---|
| 3,894,938 | A * | 7/1975 | Gorring et al. | 208/97 |
| 4,376,036 | A * | 3/1983 | Garwood et al. | 208/111.15 |
| 4,510,044 | A | 4/1985 | Oleck et al. | |
| 4,568,655 | A | 2/1986 | Oleck et al. | |
| 4,683,052 | A * | 7/1987 | Degnan, Jr. et al. | 208/111 |
| 4,743,354 | A * | 5/1988 | Ward | 208/59 |
| 4,842,717 | A * | 6/1989 | Grootjans et al. | 208/118 |
| 4,867,861 | A * | 9/1989 | Abdo et al. | 208/27 |
| 4,915,817 | A * | 4/1990 | Callera et al. | 208/97 |
| 5,080,878 | A * | 1/1992 | Bowes et al. | 423/328 |
| 5,084,159 | A * | 1/1992 | Abdo et al. | 208/109 |
| 5,332,490 | A * | 7/1994 | Taylor, Jr. et al. | 208/111 |
| 5,391,286 | A * | 2/1995 | Dai et al. | 208/27 |
| 5,804,058 | A | 9/1998 | Grandvallet et al. | |
| 6,051,127 | A * | 4/2000 | Moureaux | 208/58 |
| 6,287,454 | B1 * | 9/2001 | Forbus, Jr. et al. | 208/28 |

FOREIGN PATENT DOCUMENTS

| | | | |
|---|---|---|---|
| EP | 113381 | A1 * | 7/1984 |
| EP | 0 180 354 | A | 5/1986 |
| EP | 0 313 276 | A | 4/1989 |
| EP | 0 773 277 | A | 5/1997 |
| EP | 832171 | B1 * | 1/2000 |
| WO | 96 26993 | A | 9/1996 |
| WO | WO 9801515 | A1 * | 1/1998 |

* cited by examiner

*Primary Examiner*—Walter D. Griffin
(74) *Attorney, Agent, or Firm*—Charles W. Stewart

(57) ABSTRACT

Process for the catalytic dewaxing of a hydrocarbon oil feed including waxy molecules and more than 500 ppmw of sulphur or sulphur containing compounds by contacting the oil feed under catalytic dewaxing conditions with a catalyst composition comprising at least a hydrogenation component, dealuminated aluminosilicate zeolite crystallites and a low acidity refractory oxide binder material which is essentially free of alumina.

39 Claims, No Drawings

CATALYTIC DEWAXING PROCESS

BACKGROUND OF THE INVENTION

The invention is related to a process for the catalytic dewaxing of a hydrocarbon oil feed including waxy molecules and more than 500 ppmw of sulphur or sulphur containing compounds with a catalyst composition comprising at least a binder, aluminosilicate zeolite crystallites and a Group VIII metal. The invention is especially directed to a process to prepare a low pour point lubricating base oil stock or a middle distillate having both a low pour point and cloud point.

It is well known that catalysts comprising alumino-silicate zeolite crystallites will deactivate when used in a process for the catalytic dewaxing of a hydrocarbon oil feed in the presence of high amounts of sulphur. For example in U.S. Pat. No. 5,723,716 it is stated that waxy feeds secured from natural petroleum sources will contain quantities of sulphur and nitrogen compounds which are known to deactivate wax hydroisomerisation catalysts. Exemplary catalysts described in this patent publication comprised palladium on zeolites having the TON topology. According to this patent specification this deactivation is prevented by using a feed containing no more than 10 ppm sulphur and no more than 2 ppm nitrogen.

WO-A-9801515 describes the dewaxing of an oil feed having a sulphur content of 45 ppmw and a nitrogen content of 1 ppmw using a dewaxing catalyst comprising 0.8% w platinum supported on a carrier consisting of surface dealuminated ZSM-5 having a silica to alumina molar ratio of 51.6 and a silica binder (70% w surface dealuminated ZSM-5 and 30% w silica binder). According to this patent publication these low levels of sulphur and nitrogen in the dewaxing feedstock are needed because sulphur and nitrogen are known to poison the noble metal-based dewaxing catalyst. According to this patent publication the sulphur and nitrogen contents are decreased in the oil feed by first hydrocracking, also referred to as hydrotreating, the feed and subsequently separating a sulphur and nitrogen rich gaseous fraction from the liquid hydrocracker effluent.

U.S. Pat. No. 4,797,266 describes in their examples a catalytic dewaxing process of a hydrocarbon oil feed containing 29 ppmw of nitrogen compounds and 2800 ppmw of sulphur compounds by using a combined ZSM-5/ferrierite/palladium containing catalyst. In order to maintain a constant pour point reduction the reaction temperature had to be raised by 1.9° F. per day due to catalyst activity decline. According to this publication the temperature raise in case a ZSM-5/palladium catalyst was used was 6.3° F. per day.

WO-A-9641849 describes a dewaxing catalyst composition comprising palladium and/or platinum, an aluminosilicate zeolite crystallites having medium pore size, a diameter in the range of from 0.35 to 0.80 nm, and a low acidity refractory oxide binder material which is essentially free of alumina, wherein the surface of the aluminosilicate zeolite crystallites has been modified by subjecting the aluminosilicate zeolite crystallites to a surface dealumination treatment. No indication is given in this publication that such a catalyst would be stable when using a feed with a high content of sulphur and nitrogen.

EP-A-180354 describes the simultaneous catalytic dewaxing, denitrogenation and desulphurization of a vacuum gas oil by making use of a catalyst composition consisting of nickel, molybdenum, and zeolite beta and an alumina binder. A disadvantage of simultaneous dewaxing and hydrotreating is the lack of flexibility between both modes of operation. For example in winter you may require more dewaxing, to achieve good cold flow properties, while in summer only hydrotreating activity is desired.

The object of this invention is a dewaxing process in which the decline in catalyst activity is less severe as in the process of U.S. Pat. No. 4,797,266 when a hydrocarbon oil feed is used containing higher levels of sulphur compounds.

SUMMARY OF THE INVENTION

This object is achieved with the following process. Process for the catalytic dewaxing of a hydrocarbon oil feed including waxy molecules and more than 500 ppmw of sulphur or sulphur containing compounds by contacting the oil feed under catalytic dewaxing conditions with a catalyst composition comprising a Group VIII metal hydrogenation component, dealuminated aluminosilicate zeolite crystallites and a low acidity refractory oxide binder material which is essentially free of alumina.

It has been found that the catalyst of the process according to the invention is very stable over time even though a high content of sulphur is present in the oil feed.

The present invention can suitably be used to prepare a low pour point lubricating base oil stock or a middle distillate having both a low pour point and cloud point, wherein the feedstock of the catalytic dewaxing step in such a process contains a high content of sulphur. The invention is especially suitable for catalytic dewaxing of solvent refined base oil stocks, gas oils and hydrocracker feedstock in a process to prepare middle distillates. Below these three preferred embodiments will be described in more detail.

DETAILED DESCRIPTION OF THE INVENTION

By catalytic dewaxing is here meant a process for decreasing the pour point or cloud point by selectively converting the components of the oil feed which impart a high pour point or cloud point to products which do not impart a high pour point or cloud point. Products which impart a high pour point or cloud point are compounds having a high melting point. These compounds are referred to as waxes. Wax compounds include for example high temperature melting normal paraffins, iso-paraffins and mono-ringed compounds. The pour point or cloud point is preferably reduced by at least 10° C. and more preferably by at least 20° C. It has been found possible to reduce the cloud and pour point by more than 30° C., which is very advantageous when preparing some winter grade gas oil (diesel) fuels.

In a first preferred embodiment a low pour point lubricating base oil stock is prepared. Because the process according to the invention is very tolerant towards the sulphur in the feed it can advantageously replace solvent dewaxing process steps in an existing process to prepare lubricating base oils. In such a process the oil feed is suitably obtained by first distilling a crude petroleum feedstock at atmospheric pressures and subsequently performing a vacuum distillation on the residue of the atmospheric distillation. The distillate products obtained in the vacuum distillation, also referred to as vacuum distillates, are possible feedstocks from which the various lubricating base oils products are prepared. The boiling range of the vacuum distillates are suitably between 300 and 620° C. and preferably between 350 and 580° C. Another feedstock for lubricating base oils are the residues of the above mentioned vacuum distillation which have been subjected to a deasphalting treatment.

Suitably undesirable aromatics will first be removed from the vacuum distillates and deasphalted vacuum residues by solvent extraction. Examples of possible solvents are phenol, furfural or N-methylpyrolidone of which furfural is especially preferred. The mixture obtained in the solvent extraction is often referred to as solvent extracted waxy raffinates. The solvent extraction step is typically followed by a solvent dewaxing step in order to improve the pour point and the cloud point of the lubricating base oil product. The solvents used in the solvent dewaxing step are for example methylethylketone (MEK) or liquid propane.

Because solvent dewaxing is a semi continuous process it is for operational reasons preferred to perform the dewaxing step by means of a catalytic dewaxing process which can be performed continuously. Because known catalytic dewaxing processes are sensible to sulphur in the feedstock to be dewaxed, the oil feed is suitably first subjected to a hydrodesulphurization and/or a hydrodenitrogenation process step, also referred to as hydrotreating. Examples of these hydrotreating processes are described in WO-A-9801515 and EP-A-304251. Hydrotreating results in that the sulphur levels in the oil feed are reduced. WO-A-9801515 illustrates a hydrotreatment by contacting the oil feed at a pressure of 14 MPa in the presence of hydrogen a phosphorus promoted NiMo on (fluorided) alumina catalyst or a phosphorus promoted CoMo on (fluorided) alumina catalyst.

The process according to the invention can replace an existing solvent dewaxing step without the need for also adding a hydrotreating step to reduce sulphur and the nitrogen content of the feed to the catalytic dewaxing hydroprocess.

Hydrotreated vacuum distillates or hydrotreated deasphalted vacuum residues will normally contain less than 500 ppmw of sulphur. If however the hydrocarbon oil, obtained by hydrotreating a vacuum distillate or a deasphalted vacuum residue, contains higher sulphur contents it may also be advantageously used in the process according to the invention to prepare a lubricating base oil.

In a second preferred embodiment a gas oil having a high sulphur content is used as feedstock. Typically a gas oil will be subjected to a hydrotreating step in order to reduce the sulphur content. However with the present process it is possible to first catalytically dewax the gas oil followed by hydrotreating. This is advantageous because the conversion of the linear and slightly branched paraffins which impart a high cloud and/or pour point is maximised, while cyclic compounds are unaffected. When performing a hydrotreating step first, desirable compounds, which are formed due to ring opening of the cyclic compounds, will crack resulting in a lower yield to the desired range of hydrocarbon compounds. A further advantage of this sequence of steps is that any olefins formed in the catalytic dewaxing step can be effectively hydrogenated in the subsequent hydrotreatment step.

In a preferred embodiment the process according to the invention is performed within the same vessel in which hydrotreating is performed. In such a configuration two packed beds of catalyst will be present on top of each other in a vertically oriented column. In the top bed the process according to the invention will take place while in the lower bed hydrotreating will take place. The degree of reduction in cloud and pour point can be advantageously be controlled by adjusting the temperature of the feed entering the first bed.

The gas oil to be treated is typically a fraction boiling between 120 and 500° C. obtained in the atmospheric distillation of a crude petroleum feedstock.

In a third preferred embodiment the sulphur containing feedstock of a hydrocracker, which primary products are middle distillates, is dewaxed making use of the process according the invention. In a typical hydrocracker configuration as for example described in Ward, J. W., Hydrocracking processes and catalysts (Fuel Processing Technology, 35 (1993) 55–85, Elsevier Science Publishers B. V., Amsterdam), the sulphur and nitrogen components are removed from the hydrocracker feedstock in a hydrotreating step followed by a catalytic dewaxing step to improve the cold flow properties of the middle distillates before performing the hydrocracking step. It is now possible to first perform a catalytic dewaxing step, followed by a hydrotreating step before performing the hydrocracking step. An advantage of this sequence is a higher yield to middle distillate products. Furthermore the dewaxed feed shows an improved reactivity to the subsequent process steps allowing, for example, a reduction in reaction temperature in said steps.

In a preferred embodiment the process according to the invention is performed within the same vessel in which hydrotreating is performed, compared to the stacke-bed configuration as described for gas oil dewaxing. The hydrocracking step can be either performed in a separate vessel or in the same vessel. The advantage of having the catalytic dewaxing catalyst in the upper and first catalyst bed are the same as described for gas oil dewaxing.

Typical hydrocracker feedstocks are the vacuum distillate fractions comparable to those described above for the preparation of a lubricating base oil. Typical hydrocracker processes are described in the above cited article of Ward and in for example U.S. Pat. No. 4,743,354.

The processes as for example described above are related to a dewaxing process in which the amount of sulphur in the oil feed is more than 500 ppmw and especially more than 750 ppmw and more especially higher than 1000 ppmw. The upper limit of the sulphur in the oil feed can be up to 40000 ppmw. It has been found that the oil feed may additionally contain nitrogen. Nitrogen compounds are also known to influence the stability of a dewaxing catalyst in a negative manner. For example in U.S. Pat. No. 5,273,645 it is disclosed that not all solvent extracted raffinates can be subsequently catalytically dewaxed. The high-nitrogen content levels, particularly basic nitrogen compounds, in certain solvent-extracted raffinates can cause a rapid deactivation of the dewaxing catalysts. With the process according to the invention it has now been found that hydrocarbon mixtures containing more than 10 ppmw of nitrogen compounds can be used as oil feed in the present process without experiencing a deactivation of the catalyst. The oil feed can contain up to 6000 ppmw of nitrogen compounds. The content of sulphur and nitrogen compounds here mentioned is calculated as the weight fraction of atomic sulphur and/or nitrogen. Another feedstock to be used in the present invention containing high amounts of sulphur and nitrogen is for example shale oil.

Catalytic dewaxing conditions are known in the art and typically involve operating temperatures in the range of from 200 to 500° C., preferably from 250 to 400° C., hydrogen pressures in the range of from 10 to 200 bar, preferably from 15 to 100 bar, more preferably from 15 to 65 bar, weight hourly space velocities (WHSV) in the range of from 0.1 to 10 kg of oil per liter of catalyst per hour (kg/l/hr), preferably from 0.2 to 5 kg/l/hr, more preferably from 0.5 to 3 kg/l/hr and hydrogen to oil ratios in the range of from 100 to 2,000 liters of hydrogen per liter of oil.

The catalyst composition used in the present invention comprises a hydrogenation component, a surface dealuminated aluminosilicate zeolite crystallites and a low acidity refractory oxide binder material which is essentially free of alumina. Examples of such catalysts are described in WO-A-9641849.

The aluminosilicate zeolite crystallites preferably has pores with a diameter in the range of from 0.35 to 0.80 nm. This diameter refers to the maximum pore diameter. As is generally recognised, the pores in a molecular sieve are polygonal shaped channels having a minimum and a maximum pore diameter. For the purpose of the present invention the maximum pore diameter is the critical parameter, because it determines the size of the waxy molecules which can enter the pores. More preferably the zeolite crystallites have a Constraint Index of between 2 and 12. The Constraint Index is a measure of the extent to which a zeolite provides control to molecules of varying sizes to its internal structure is the of the zeolite. Zeolites which provide a highly restricted access to and egress from its internal structure have a high value for the Constraint Index. On the other hand, zeolites which provide relatively free access to the internal zeolite structure have a low value for the Constraint Index, and usually pores of large size. The method by which Constraint Index is determined is described fully in U.S. Pat. No. 4,016,218, incorporated herein by reference for details of the method.

Constraint Index (CI) values for some typical materials are:

| | CI (At Test Temperature) | |
|---|---|---|
| ZSM-4 | 0.5 | (316° C.) |
| ZSM-5 | 6–8.3 | (371–316° C.) |
| ZSM-11 | 6–8.7 | (371–316° C.) |
| ZSM-12 | 2.3 | (316° C.) |
| ZSM-20 | 0.5 | (371° C.) |
| ZSM-22 | 7.3 | (427° C.) |
| ZSM-23 | 9.1 | (427° C.) |
| ZSM-34 | 50 | (371° C.) |
| ZSM-35 | 4.5 | (454° C.) |
| ZSM-38 | 2 | (510° C.) |
| ZSM-48 | 3.5 | (538° C.) |
| ZSM-50 | 2.1 | (427° C.) |
| TMA Offretite | 3.7 | (316° C.) |
| TEA Mordenite | 0.4 | (316° C.) |
| Clinoptilolite | 3.4 | (510° C.) |
| Mordenite | 0.5 | (316° C.) |
| REY | 0.4 | (316° C.) |
| Amorphous Silica-Alumina | 0.6 | (538° C.) |
| Dealuminized Y (Deal Y) | 0.5 | (510° C.) |
| Erionite | 38 | (316° C.) |
| Zeolite Beta | 0.6–2 | (316–399° C.) |

The very nature of the Constraint Index and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders. Likewise, other variables, such as crystal size of the zeolite, the presence of occluded contaminants, etc., may affect the Constraint Index. Therefore, it will be appreciated that it may be possible to so select test conditions, e.g., temperature, as to establish more than one value for the Constraint Index of a particular zeolite. This explains the range of Constraint Indices for zeolites, such as ZSM-5, ZSM-11 and Zeolite Beta. Examples of alumino-silicate zeolites having a Constraint Index of between 2 and 12 and which are suitable for to be used in the present invention are ferrierite, ZSM-11, ZSM-12, ZSM-22, ZSM-23, ZSM-35, ZSM-38, ZSM-48, ZSM-57, SSZ-23, SSZ-24, SSZ-25, SSZ-26, SSZ-32, SSZ-33 and MCM-22 and mixtures of two or more of these. Preferred aluminosilicate zeolites are of the MFI-topology for example ZSM-5.

The crystallite size of the zeolite may be as high as 100 micron. Preferably small crystallites are used in order to achieve an optimum catalytic activity. Preferably crystallites smaller than 10 micron and more preferably smaller than 1 micron are used. The practical lower limit is suitably 0.1 micron.

The dewaxing catalyst composition used in the present process also comprises a low acidity refractory oxide binder material which is essentially free of alumina. Examples are low acidity refractory oxides such as silica, zirconia, titanium dioxide, germanium dioxide, boria and mixtures of two or more of these. The most preferred binder is silica. The weight ratio of modified molecular sieve to binder is suitably within the range of from 05/95 to 95/05.

The dealumination of the aluminosilicate zeolite results in a reduction of the number of alumina moieties present in the zeolite and hence in a reduction of the mole percentage of alumina. The expression "alumina moiety" as used in this connection refers to an $Al_2O_3$-unit which is part of the framework of the alumino-silicate zeolite, i.e. which has been incorporated via covalent bindings with other oxide moieties, such as silica ($SiO_2$), in the framework of the aluminosilicate zeolite. The mole percentage of alumina present in the aluminosilicate zeolite is defined as the percentage of moles $Al_2O_3$ relative to the total number of moles of oxides constituting the aluminosilicate zeolite (prior to dealumination) or modified molecular sieve (after dealumination).

Preferably the surface of the zeolite crystallites are selectively dealuminated. A selective surface dealumination results in a reduction of the number of surface acid sites of the zeolite crystallites, whilst not affecting the internal structure of the zeolite crystallites.

Dealumination can be attained by methods known in the art. Particularly useful methods are those, wherein the dealumination selectively occurs, or anyhow is claimed to occur selectively, at the surface of the crystallites of the molecular sieve. Examples of dealumination processes are described in the afore mentioned WO-A-9641849.

Preferably dealumination is performed by a process in which the zeolite is contacted with an aqueous solution of a fluorosilicate salt wherein the fluorosilicate salt is represented by the formula:

$$(A)_{2/b}SiF_6$$

wherein 'A' is a metallic or non-metallic cation other than H+ having the valence 'b'. This treatment will be also referred to as the AHS treatment. Examples of cations 'b' are alkylammonium, $NH4^+$, $Mg^{++}$, $Li^+$, $Na^+$, $K^+$, $Ba^{++}$, $Cd^{++}$, $Cu^+$, $Ca^{++}$, $Cs^+$, $Fe^{++}$, $Co^{++}$, $Pb^{++}$, $Mn^{++}$, $Rb^+$, $Ag^+$, $Sr^{++}$, $Tl^+$, and $Zn^{++}$. Preferably 'A' is the ammonium cation. The zeolite material may be contacted with the fluorosilicate salt at a pH of suitably between 3 and 7. Such a dealumination process is for example described in U.S. Pat. No. 5,157,191. The dealumination treatment is referred to as the AHS-treatment.

The catalyst composition is preferably prepared by first extruding the aluminosilicate zeolite with the binder and subsequently subjecting the extrudate to a dealumination treatment, preferably the AHS treatment as described above. It has been found that an increased mechanical strength of the catalyst extrudate is obtained when prepared according to this sequence of steps.

The Group VIII metal hydrogenation component is suitable nickel, cobalt, platinum or palladium or mixtures of these metals. The total amount of Group VIII metal will suitably not exceed 10% by weight calculated as element and based on total weight of support, and preferably is in the range of from 0.1 to 5.0% by weight, more preferably from 0.2 to 3.0% by weight. The Group VIII metal is suitably added to the catalyst extrudate comprising the dealuminated aluminosilicate zeolite crystallites by known techniques, such as ion-exchange techniques. Typical ion-exchange techniques call for contacting the selected zeolite with a salt of the desired replacing cation. Although a wide variety of salts can be employed, particular preference is given to chloride, nitrates and sulphates. Representative ion-exchange techniques are disclosed in a wide variety of patents including U.S. Pat. No. 3,140,249, U.S. Pat. No. 3,140,251 and U.S. Pat. No. 3,140,253. Preferably the catalyst composition only comprises a Group VIII metals as the hydrogenation component. For example such catalyst compositions especially does not contain a Group VIB metal, like tungsten or molybdenum.

The invention will be illustrated by the following non-limiting examples.

EXAMPLE 1

A dealuminated ZSM-5 catalyst was prepared according to the following procedure. ZSM-5 (obtained from PQ company) was extruded with a silica binder (70% by weight of ZSM-5 with a silica-alumina ratio of 50 and 30% by weight of silica binder). The extrudates were dried for 4 hours at 120° C. and then calcined for 2 hours at 550° C. 1329 ml of a 0.11 N ammonium hexafluorosilicate solution were added to a slurry containing 60 grams of the thus obtained extrudate and 590 ml deionised water. The reaction mixture was heated to 100° C. and with gentle stirring maintained at this temperature for 17 hours. After filtration, the extrudates were washed with deionised water and dried at 120° C. for 2 hours and calcined for 2 hours at 480° C.

Subsequently said modified silica-bound ZSM-5 was ion-exchanged with an aqueous solution of platinum tetramine hydroxide followed by drying (2 hours a 120° C.) and calcining (2 hours at 300° C.). The catalyst was activated by reduction of the platinum under a hydrogen rate of 100 l/hr at a temperature of 350° C. for 2 hours resulting in a catalyst containing 0.7 wt % platinum.

Subsequently a waxy raffinate having the properties as listed in Table I was contacted in the presence of hydrogen with the above prepared catalyst at a temperature of 345° C., an outlet pressure of 40 bar, a weight hourly space velocity (WHSV) of 1.0 kg/l.hr and a once through gas rate of 700 Nl/kg.

TABLE 1

| | | | |
|---|---|---|---|
| Density (d70/4) | 0.8407 | Flash point | >250° C. |
| Refractive index (n70/D) | 1.464 | Pour point | +48° C. |
| Viscosity at 80° C. ($mm^2/s$) | 16.63 | IBP | 384° C. |
| Viscosity at 100° C. ($mm^2/s$) | 9.84 | T50 | 501° C. |
| Viscosity at 120° C. ($mm^2/s$) | 6.48 | FBP | 588° C. |
| Sulphur (mg/kg) | 7100 | | |
| Nitrogen (mg/kg) | 42 | | |

Pour point measured by NF T 60–105, Initial boiling point (IBP), T50 and final boiling point (FBP) measured by ASTM D 2892m, kinematic viscosities by NF-EN-ISO 3104, sulphur by ASTM D 5453, nitrogen content by SMS 2695m.

The results of the experiment are summarised in Table 2.

TABLE 2

| on stream time (hours) | 0 | 95 | 175 | 295 | 970 |
|---|---|---|---|---|---|
| temperature (° C.) | 345 | 345 | 345 | 345 | 345 |
| 390° C.$^+$ yield (w % on feed) | 75.5 | 76.2 | 76.0 | 75.8 | 75.7 |
| viscosity index (VI) | 91 | 91 | 92 | 91.5 | 91.5 |
| pour point (±1° C.) | −11 | −10 | −10 | −11 | −8 |

The results in Table 2 show that for almost 1000 hours of on-stream time a product of constant the same good quality can be obtained without having to increase the operating temperature. The need to increase the operating temperature in order to maintain a constant product quality when the dewaxing catalyst deactivates is for example described in the earlier mentioned U.S. Pat. No. 4,797,266 and EP-A-304251.

EXAMPLE 2

A catalyst composition consisting of 30 wt % dealuminated ZSM-5, 70 wt % silica binder on which nickel is ion exchanged to a nickel content of 0.7 wt % was prepared according to the procedure as described in Example 1.

A straight run gas oil having the properties as stated in Table 3 was contacted with the above catalyst in the presence of hydrogen at a temperature of 390° C., a hydrogen partial pressure of 48 bar and a $H_2S$ partial pressure of 2 bar. The weight hourly space velocity (WHSV) was 3.3 kg/l.hr. The gas to oil ratio was 250 Nl/kg. The cloud point of the gas oil was lowered by 15° C. See Table 4 for more results.

TABLE 3

| Property | Straight run gas oil properties |
|---|---|
| Specific gravity D20/4 | 0.854 |
| Sulphur, % wt | 1.44 |
| Nitrogen, ppm | 157 |
| Distillation - ASTM D86 | |
| 10% vol. | 258 |
| 50% vol. | 305 |
| 90% vol. | 357 |
| Cold Flow Properties | |
| Pour Point, ° C. | −3 |
| Cloud Point, ° C. | +3 |

EXAMPLE 3

Example 2 was repeated except that the temperature was 400° C. in order to achieve a 30° C. reduction in cloud point. See Table 4 for more results.

Comparative Experiment A

Example 2 was repeated except that the catalyst was a conventional gas oil dewaxing catalyst consisting of 60 wt % untreated ZSM-5, 40 wt % alumina binder on which about 2 wt % nickel was impregnated.

The required temperature to achieve the same 15° C. cloud point reduction as in Example 2 was 396° C. Thus in spite of the higher zeolite content of the catalyst a lower activity is observed when compared to Example 2. Furthermore a lower gas oil yield and a higher gas make is observed compared to Example 2. See also Table 4.

Comparative Experiment B

Example 3 was repeated except that the catalyst of Comparative experiment A was used. The required temperature to achieve the 30° C. reduction in cloud point was 406° C. See also Table 4 for more results.

TABLE 4

| | Comparative Example A/B | Examples 2/3 |
|---|---|---|
| Catalyst Characteristics: | | |
| Zeolite content | 60 wt % | 30 wt % |
| Zeolite type | ZSM-5 | ZSM-5 |
| Binder | $Al_2O_3$ | $SiO_2$ |
| Chemical treatment | None | AHS treatment (see description) |
| Test Results: | | |
| For a delta cloud point of 15° C. | Comparative experiment A | Example 2 |
| Temperature required, ° C. | 396 | 390 |
| Yields, wt % 177° C.+ | 88 | 90 |
| For a delta cloud point of 30° C. | Comparative Experiment B | Example 3 |
| Temperature required, ° C. | 406 | 400 |
| Yields, wt % 177° C.+ | 82 | 84 |

EXAMPLE 4

Example 2 was repeated and followed in time while keeping the reduction in cloud point more or less constant. Table 5 shows the gas oil yield and the required temperature for various run hours of the experiment. It follows from these results that even after 1550 hours of continuous operation the temperature does not have to be raised in order to achieve the desired cloud point reduction. This is a clear indication that the catalyst is very stable in the presence of sulphur in the feed and $H_2S$ in the hydrogen gas used. A deactivation rate based on these results will be less than 1° C./1000 hours (±1° C./1000 hours).

TABLE 5

| Run hour | 800 | 1100 | 1550 |
|---|---|---|---|
| temperature (° C.) | 389 | 389 | 389 |
| 177° C.+ yield, wt % | 88.9 | 90.5 | 90.1 |
| Cloud point, ±1° C. | −12 | −10 | −11 |

Comparative Experiment C

Example 4 was repeated with the catalyst of Comparative Experiment A. The same reduction in cloud point was achieved during the course of the experiment as in Example 4. Base on the results a deactivation rate of 4° C./1000 hours (±1° C./1000 hours) was estimated. This results shows that the process according to the invention is very stable when feedstocks containing high levels of sulphur are subjected to a catalytic dewaxing treatment.

EXAMPLE 5

This example will illustrate the advantages of first performing a catalytic dewaxing step prior to a hydro-treating step to prepare an intermediate product suitable for performing a hydrocracking step in a process to prepare middle distillates. The feedstock used in this example was a heavy flashed distillate of a Arabian Light crude. The main characteristics of the distillate feedstock are given in Table 6.

TABLE 6

Feedstocks used in Example 5

| PROPERTIES: | | |
|---|---|---|
| Density at 15/4° C. | g/ml | 0.9308 |
| Pour point, | ° C. | 42 |
| Sulphur content, | % w | 2.590 |
| Total nitrogen content, | ppmw | 950 |
| 10% w recovery, | ° C. | 403 |
| 50% w recovery, | ° C. | 482 |
| 90% w recovery, | ° C. | 557 |

The Catalysts used in the following examples/experiments were:

Hydrodewaxing Catalyst, having a bulk density of 0.64894 kg/l: this catalyst was prepared according to the principles described in U.S. Pat. No. 5,804,058. 70 wt % of ZSM-5 powder was extruded with 30 wt % of silica binder (of which 7 wt % of $SiO_2$ powder HP321, 23 wt % of silica sol Ludox AS40), dried 4 hours at 120° C. and then calcined 2 hours at 550° C.

The extrudates were subsequently dealuminated according to the standard procedure as described in U.S. Pat. No. 5,804,058 using ammonium hexafluorosilicate as the dealuminating agent. The catalyst was subsequently washed, dried 2 hours at 120° C. and calcined 2 hours at 480° C. The final step was a Nickel exchange (aiming at 1 wt % Ni in the final catalyst) using $Ni(NO_3)_2.6H_2O$ in a solution of water and $NH_4OH$ (650 ml $H_2O$+100 ml $NH_4OH$ containing 28% $NH_3$ for 75 g of extrudates). The final catalyst is then dried 2 hours at 150° C. and calcined 2 hours at 400° C.

Hydrotreating catalyst: commercial C-424 catalyst from Criterion Catalyst Company.

Process Conditions:

The process conditions used in both examples and comparative experiments are typical operating conditions for hydrotreating. 1 $cm^3$ of hydrodewaxing catalyst as described above was loaded on top of 5 $cm^3$ of commercial hydrotreating catalyst C-424. The overall space velocity applied was 2.1 kg/l.h, i.e. 2.5 kg/l.h on C-424, 12.6 kg/l.h on the dewaxing catalyst. The above feed was contacted, in the presence of 115 bar hydrogen, with the stacked catalyst at a hydrogen gas rate of 1000 Nl/kg feed. The results are presented in Table 7. Deactivation was measured as in Example 4.

COMPARATIVE EXAMPLE D

Example 5 was repeated except that as dewaxing catalyst 1 $cm^3$ of a conventional commercially available dewaxing catalyst (Ni on ZSM-5/$Al_2O_3$) was loaded on top of the 5 $cm^3$ of commercial hydrotreating catalyst C-424. The results of the experiment are presented in Table 7. Deactivation was measured as in Example 4.

Comparative Experiment E

Example 5 was repeated except that no dewaxing catalyst was present. Furthermore some extra C-424 was loaded in the reactor in order to achieve the same weight hourly space velocity as in Example 5. Thus 6 $cm^3$ of commercial C-424 was loaded in the reactor. The space velocity on the hydrotreating catalyst was 2.5 kg/l.h. The results of the experiment are presented in Table 7. Deactivation was measured as in Example 4.

TABLE 7

| | Example 5 | Comparative Experiment D | Comparative Experiment E |
|---|---|---|---|
| Catalyst package | Improved dewaxing + Hydro-treating | Conventional dewaxing + Hydro-treating | Hydro-treating |
| Catalyst volume (total), $cm^3$ | 6 (1 + 5) | 6 (1 + 5) | 6 |
| Overall WHSV, kg/l · h | 2.1 | 2.1 | 2.1 |
| Temperature in the catalyst(s) bed(s) required for a 14 wt % conversion of 370° C.+ | 389 | 393 | 394 |
| Yields at 14% 370° C.+ conversion, % wt on feed | | | |
| C1–C4 | 1.7 | 3.7 | 0.4 |
| C5–150° C. | 3.0 | 5.1 | 1.2 |
| >150° C. | 93.7 | 91.2 | 96.5 |
| Effluent Pour point, ° C. | +30 | +30 | +42 |
| Deactivation Rate, ° C./1000 h | 1.4 | >5.0 | 1.5 |

Example 5 and the comparative experiments D and E illustrates the advantage of performing the process according to the invention prior to hydrotreating in a process to prepare middle distillates. This because temperature requirement for a given conversion level in Example 5 is lower than in the comparative experiments illustrating a more active catalyst. Example 5 furthermore shows a combined improvement in cold flow improvement and yield to products boiling in the 150+° C. range. Furthermore the catalyst of the process according to the invention shows a better stability as can be concluded based on the relatively lower deactivation rate.

What is claimed is:

1. A process for the catalytic dewaxing of a hydrocarbon oil feed obtained by the vacuum distillation of the residue of an atmospheric distillation of a crude petroleum feedstock, wherein said hydrocarbon oil feed has a boiling range between 300° C. and 620° C. includes waxy molecules and more than 1000 ppmw of sulphur or sulphur containing compounds and said hydrocarbon oil feed has not been subjected to a hydrotreating step to reduce sulfur and nitrogen content, by contacting said hydrocarbon oil feed under catalytic dewaxing conditions with a catalyst composition comprising a Group VIII metal hydrogenation component selected from the group consisting of platinum palladium and nickel, dealuminated aluminosilicate zeolite crystallites and a low acidity refractory oxide binder material which is essentially free of alumina.

2. The process of claim 1, in which said hydrocarbon oil feed further comprises more than 10 ppmw of nitrogen or nitrogen containing compounds.

3. The process of claim 1, in which the low acidity binder is silica.

4. The process of claim 1, in which the aluminosilicate zeolite crystallites have a Constraint Index of between 2 and 12.

5. The process of claim 4, in which the aluminosilicate zeolite crystallites include MFI type zeolite.

6. The process of claim 1, in which the dealuminated aluminosilicate zeolite crystallites are obtained by contacting the zeolite crystallites with an aqueous solution of a fluorosilicate salt wherein the fluorosilicate salt is represented by the formula:

$$(A)_{2/b}SiF_6$$

in which 'A' is a metallic or non-metallic cation other than H+ having the valence 'b'.

7. The process of claim 6, in which an extrudate of the aluminosilicate zeolite crystallites and the low acidity binder is contacted with the aqueous solution of the fluorosilicate salt.

8. The process of claim 1, in which said hydrocarbon oil feed is a solvent extracted waxy raffinate that has been obtained further by the solvent extraction of the vacuum distillate obtained by the vacuum distillation of the residue of said atmospheric distillation of said crude petroleum feedstock.

9. The process of claim 6, where 'A' is an ammonium cation.

10. The process of claim 1, in which the hydrogenation component is palladium.

11. The process of claim 1, in which the hydrogenation component is nickel.

12. A process for the catalytic dewaxing of a hydrocarbon oil feed obtained by the vacuum distillation of the residue of an atmospheric distillation of a crude petroleum feedstock, wherein said hydrocarbon oil feed has a boiling range between 300° C. and 620° C. includes waxy molecules and more than 1000 ppmw of sulphur or sulphur containing compounds compounds and said hydrocarbon oil feed has not been subjected to a hydrotreating step to reduce sulfur and nitrogen content, by contacting said hydrocarbon oil feed under catalytic dewaxing conditions with a catalyst composition comprising a nickel hydrogenation component, dealuminated aluminosilicate zeolite crystallites and a low acidity refractory oxide binder material which is essentially free of alumina.

13. The process of claim 12, wherein said hydrocarbon oil feed further comprises more than 10 ppmw of nitrogen or nitrogen containing compounds.

14. The process of claim 13, wherein said low acidity binder is silica.

15. The process of claim 14, wherein said aluminosilicate zeolite crystallites have a Constraint Index of between 2 and 12.

16. The process of claim 15, wherein said aluminosilicate zeolite crystallites include MFI type zeolite.

17. The process of claim 16, wherein said dealuminated aluminosilicate zeolite crystallites are obtained by contacting the zeolite crystallites with an aqueous solution of a fluorosilicate salt wherein the fluorosilicate salt is represented by the formula:

$$(A)_{2/b}SiF_6$$

in which 'A' is a metallic or non-metallic cation other than H+ having the valence 'b'.

18. The process of claim 17, wherein an extrudate of the aluminosilicate zeolite crystallites and the low acidity binder is contacted with the aqueous solution of the fluorosilicate salt.

19. The process of claim 18, wherein 'A' is an ammonium cation.

20. The process of claim 19, wherein said catalyst composition has an absence of a Group VIB metal component.

21. The process of claim 7, wherein said catalyst composition has an absence of a Group VIB metal component.

22. A catalytic dewaxing process, comprising:

vacuum distilling a residue from an atmospheric distillation of a crude petroleum feedstock that contains a sulfur compound and a nitrogen compound to yield a vacuum distillate having a boiling range between 300° C. and 620° C.;

subjecting said vacuum distillate to a solvent extraction with a solvent to thereby yield a solvent extracted waxy raffinate having a reduced aromatics content from that of said vacuum distillate, wherein said solvent extracted waxy raffinate contains waxy molecules and more than 1000 ppmw of sulfur or sulfur containing compounds; and without being subjected to a hydrotreating step to reduce the sulfur and nitrogen content of said solvent extracted waxy raffinate, contacting said solvent extracted waxy raffinate, under catalytic dewaxing conditions, with a catalyst composition comprising dealuminated aluminosilicate zeolite crystallites, a low acidity refractory oxide binder material which is essentially free of alumina, and a Group VIII metal hydrogenation component selected from the group consisting of platinum, palladium and nickel.

23. A dewaxing process as recited in claim 22, wherein said solvent extracted waxy raffinate further contains more than 10 ppmw of nitrogen or nitrogen compounds.

24. A dewaxing process as recited in claim 23, wherein the low acidity refractory oxide binder of said catalyst composition is silica.

25. A dewaxing process as recited in claim 24, wherein the dealuminated aluminosilicate zeolite crystallites of said catalyst composition have a Constraint Index of between 2 and 12.

26. A dewaxing process as recited in claim 25, wherein the dealuminated aluminosilicate zeolite crystallites of said catalyst composition include MFI type zeolite.

27. A dewaxing process as recited in claim 26, wherein the dealuminated aluminosilicate zeolite crystallites of said catalyst composition are obtained by contacting the zeolited crystallites with an aqueous solution of a fluorosilicate salt wherein the fluorosilicate salt is represented by the formula: $(A)_{2/b}SiF_6$ in which 'A' is a metallic or non-metallic cation other than H+ having the valence 'b'.

28. A dewaxing process as recited in claim 27, wherein in the preparation of said catalyst composition the dealuminated aluminosilicate zeolite crystallites and low acidity refractory oxide binder material are formed into an extrudate and then contacted with said aqueous solution of fluorosilicate salt prior to the incorporation into said extrudate said Group VIII metal hydrogenation component.

29. A dewaxing process as recited in claim 28, wherein 'A' is an ammonium cation.

30. A dewaxing process as recited in claim 29, wherein said catalyst composition has an absence of a Group VIB metal component.

31. A catalytic dewaxing process, comprising:

vacuum distilling a residue from an atmospheric distillation of a crude petroleum feedstock that contains a sulfur compound and a nitrogen compound to yield a vacuum distillate having a boiling range between 300° C. and 620° C. and containing more than 1000 ppmw of sulfur or sulfur containing compounds; and without being subjected to a hydrotreating step to reduce the sulfur or nitrogen content of said vacuum distillate, contacting said vacuum distillate, under catalytic dewaxing conditions, with a catalyst composition comprising dealuminated aluminosilicate zeolite crystallites, a low acidity refractory oxide binder material which is essentially free of alumina, and a Group VIII metal hydrogenation component selected from the group consisting of platinum, palladium and nickel.

32. A dewaxing process as recited in claim 31, wherein said vacuum distillate further contains more than 10 ppmw of nitrogen or nitrogen compounds.

33. A dewaxing process as recited in claim 32, wherein the low acidity refractory oxide binder of said catalyst composition is silica.

34. A dewaxing process as recited in claim 33, wherein the dealuminated aluminosilicate zeolite crystallites of said catalyst composition have a Constraint Index of between 2 and 12.

35. A dewaxing process as recited in claim 34, wherein the dealuminated aluminosilicate zeolite crystallites of said catalyst composition include MFI type zeolite.

36. A dewaxing process as recited in claim 35, wherein the dealuminated aluminosilicate zeolite crystallites of said catalyst composition are obtained by contacting the zeolited crystallites with an aqueous solution of a fluorosilicate salt wherein the fluorosilicate salt is represented by the formula: $(A)_{2/b}SiF_6$ in which 'A' is a metallic or non-metallic cation other than H+ having the valence 'b'.

37. A dewaxing process as recited in claim 36, wherein in the preparation of said catalyst composition the dealuminated aluminosilicate zeolite crystallites and low acidity refractory oxide binder material are formed into an extrudate and then contacted with said aqueous solution of fluorosilicate salt prior to the incorporation into said extrudate said Group VIII metal hydrogenation component.

38. A dewaxing process as recited in claim 37, wherein 'A' is an ammonium cation.

39. A dewaxing process as recited in claim 38, wherein said catalyst composition has an absence of a Group VIB metal component.

* * * * *